US005232011A

United States Patent [19]

Royalty

[11] Patent Number: 5,232,011

[45] Date of Patent: Aug. 3, 1993

[54] FLUSH VALVE LEAKAGE PREVENTION AND DETECTION DEVICE

[75] Inventor: Galen E. Royalty, Silver Spring, Md.

[73] Assignee: Waterguard, Inc., Rockville, Md.

[21] Appl. No.: 830,302

[22] Filed: Jan. 31, 1992

[51] Int. Cl.[5] ..... F16K 31/20; F16K 33/00

[52] U.S. Cl. ..... 137/410; 4/324; 4/366; 4/415; 4/427; 137/421; 137/426

[58] Field of Search ..... 4/324, 366, 381, 384, 4/385, 386, 415, 325, 405, 427; 137/410, 420, 421, 426; 251/74

[56] References Cited

U.S. PATENT DOCUMENTS

| | | | |
|---|---|---|---|
| 265,709 | 10/1882 | Sniffen | 4/366 |
| 1,984,394 | 12/1934 | Candee | 4/366 |
| 2,837,111 | 6/1958 | Mueller | 137/410 |
| 2,841,169 | 7/1958 | Martin et al. | 137/400 |
| 3,095,577 | 7/1963 | Clark | 4/333 |
| 3,348,242 | 10/1967 | Wilhelm | 4/366 |
| 3,363,643 | 1/1968 | Skulski | 137/421 |
| 3,401,717 | 9/1968 | Lamb | 137/421 |
| 3,419,912 | 1/1969 | Kertell | 4/324 |
| 4,216,555 | 8/1980 | Detjen | 4/415 |
| 4,296,505 | 10/1981 | Chien-Sheng | 4/324 |
| 4,351,071 | 9/1982 | Clar | 4/324 |
| 4,391,003 | 7/1983 | Talerico et al. | 4/415 |
| 4,485,501 | 12/1984 | Kloner | 4/405 |
| 4,700,413 | 10/1987 | Lopez | 4/324 |
| 4,791,689 | 12/1988 | De Couto | 4/366 |
| 4,843,657 | 7/1989 | Orr | 4/405 |
| 4,901,377 | 2/1990 | Weir | 4/415 |
| 5,083,323 | 1/1992 | Cannan | 4/415 |

FOREIGN PATENT DOCUMENTS 488402 7/1938 United Kingdom .

*Primary Examiner*—George L. Walton

[57] ABSTRACT

A flush valve leakage prevention and detection device includes a latch for supporting a float lever of a float controlled water inlet valve assembly of a toilet tank in a raised, latched position corresponding to a closed position for the water inlet valve assembly, with a control arm on the latch being engaged by a flush lever of the toilet tank. A support pivotally mounts the latch within the toilet tank, and the latch is rotationally biased relative to the pivot such that the control arm is urged in supporting engagement upon the flush lever and the latch is positioned to hold the float lever in the raised, latched position. The control arm is movable in response to movement of the flush lever in initiating a flush cycle to rotate the latch against the bias to release the float lever allowing the float lever to move to a lowered position corresponding to an open position for the water inlet valve assembly and to automatically engage and latch the float lever once the float lever has returned to the raised position preventing opening of the water inlet valve assembly in the event that water leaks from the toilet tank between flush cycles.

20 Claims, 3 Drawing Sheets

40
38
170
84
52
174
172
50
46
56
30
34
24
182
186
184
180
26
188
160
168
156
112
54
166
162
42
68
70
58
100
32
102
64
60

FLUSH VALVE LEAKAGE PREVENTION AND DETECTION DEVICE

BACKGROUND OF THE INVENTION

1. Field Of The Invention

The present invention pertains to toilet tanks and, more particularly, to devices for preventing and detecting leakage of water through flush valves of the toilet tanks between flush cycles.

2. Description of the Prior Art

Most toilet tanks include a float movable with the water level in the tank during flush cycles to operate a water inlet valve to refill the tank upon lowering of the water from a predetermined level and to close the water inlet valve once the tank is refilled to the predetermined level. During flush cycles, operation of a flush lever unseats a flush valve in the tank causing the water in the tank to be released through a discharge opening, and the float descends in response to lowering of the water level from the predetermined level causing opening of the water inlet valve to refill the tank with closure of the flush valve. As the toilet tank is refilled, the float ascends in response to raising of the water level and, when the water level returns to the predetermined level, operates to close the water inlet valve and prevent further supply of water to the toilet tank. A problem exists where the water level in the tank drops from the predetermined water level not due to flushing but due to leakage, typically through the flush valve, between flush cycles in that the float operates to open the water inlet valve allowing water to flow into the tank to replace that lost through leakage. Where the leakage is continual, the float operates to keep the water inlet valve open and water continually flows into the tank and through the discharge opening; however, the leakage can be sporadic or intermittent such that the float operates at unspecified times to open the water inlet valve. Both types of leakage commonly occur and are difficult to detect audibly and visually such that the leakage problem can remain undetected. In many cases, consumers are alerted to major, continual leakage only through drastically high water utility bills while insidious or sporadic leakage can remain unrecognized with consumers inadvertently absorbing inflated water utility costs of the leakage. In addition to a direct economic burden on consumers, the aggregate effect of water leakage through deficient flush valves of toilet tanks is the waste of untold gallons of water, an increasingly scarce resource.

Various devices have been proposed to prevent opening of water inlet valves of toilet tanks except when the flush levers are actuated such that refilling of the tanks between flush cycles is prevented when the water level drops due to leakage, and U.S. Pat. Nos. 4,901,377 to Weir, 4,843,657 to Orr, 3,095,577 to Clark, 2,841,169 to Martin et al, 265,709 to Sniffen and Great Britain Patent 488,402 are illustrative of such devices. Some of the disadvantages of prior art toilet tank leakage prevention devices are that the devices can not be easily retrofit to the many, diverse flush mechanisms, water inlet valves and toilet tanks in use, the devices are structurally and functionally complex with the need for numerous, expensive components, the devices are not suitable for universal use on the various types of water inlet valves, i.e. ball cock and FLUIDMASTER valves, currently found in existing toilet tanks, the devices are particularly susceptible to failure and malfunction, the devices do not limit the amount of water allowed to leak from the toilet tanks and the devices do not serve to promptly indicate or detect leakage.

SUMMARY OF THE INVENTION

Accordingly, it is primary object of the present invention to overcome the aforementioned disadvantages of prior art toilet tank leakage prevention devices.

Another object of the present invention is to provide a flush valve leakage prevention and detection device for limiting leakage from a toilet tank to a single tank of water and thereafter preventing further leakage from the tank between flush cycles.

A further object of the present invention is to prevent refilling of a toilet tank upon emptying of the water in the tank due to leakage between flush cycles such that the empty tank will be discovered upon attempting to initiate the next flush cycle thereby serving as an indication or detection of leakage.

It is also an object of the present invention to support a float arm or lever of a float controlled water inlet valve assembly of a toilet tank in a raised position to prevent lowering of the arm or lever when the water level in the tank drops due to leakage between flush cycles such that the water inlet valve assembly can not be opened.

Yet another object of the present invention is to support a float arm or lever of a float controlled water inlet valve assembly of a toilet tank in a raised position and to allow the float arm or lever to move to a lowered position to open the water inlet valve assembly only upon initiation of a flush cycle.

A still further object of the present invention is to utilize a cam action to release a float arm or lever of a float controlled water inlet valve assembly of a toilet tank to allow opening of the water inlet valve assembly in response to rotation of a flush lever.

Another object of the present invention is to provide a flush valve leakage prevention and detection device with a control arm supported on a flush lever of a toilet tank such that movement of the flush lever is transmitted via the control arm to unlatch a float arm or lever arm of a float controlled water inlet valve assembly.

The present invention has an additional object in that the closing force applied at a float controlled water inlet valve assembly of a toilet tank is effectively increased to ensure closure of the water inlet valve assembly.

Some of the advantages of the present invention are that leakage through flush valves can be detected without the need for dyes, audible listening devices and other extraneous products, continual, sporadic or intermittent leaks through flush valves can be readily detected, consumers can avoid inflated water utility costs due to leakage through flush valves, the flush valve leakage prevention and detection device can be easily retrofit to existing toilet tanks, the flush valve leakage prevention and detection device can be easily customized for installation on the various, diverse types of toilet tanks, water inlet valve assemblies and flush mechanisms presently employed in toilet tanks, wasteful use of water can be eliminated, leakage of more than a single tank of water from toilet tanks is prevented, the flush valve leakage prevention and detection device can be provided as part of a conventional water inlet valve assembly with only slight modification of the water inlet valve assembly required and the flush valve leakage prevention and detection device can be inexpensively manufactured with relatively few operating components for structural and functional simplicity and enhanced reliability.

The present invention is generally characterized in a flush valve leakage prevention and detection device including a latch for supporting a float lever or arm of a float controlled water inlet valve assembly of a toilet tank in a raised, latched position corresponding to a closed position for the water inlet valve assembly and a support having a pivot pivotally supporting the latch in the toilet tank with the weight of the control arm outwardly of the pivot urging or biasing the latch to rotate around the pivot and to be disposed in supporting engagement upon the flush lever. The latch is movable in response to movement of the flush lever in initiating a flush cycle to rotate around the pivot in opposition to the rotational bias to release the float lever or arm, allowing the float lever or arm to move to a lowered position corresponding to an open position for the water inlet valve assembly upon lowering of the water level in the toilet tank from a predetermined level due to opening of a flush valve with movement of the flush lever. The latch is movable in response to movement of the float lever or arm from the lowered position to the raised position with raising of the water level in the tank to automatically engage and latch the float lever or arm in the raised position corresponding to the closed position for the water inlet valve assembly such that the water inlet valve assembly remains closed and cannot be opened in the event that water leaks from the tank prior to the next flush cycle. Should water leak from the toilet tank through the flush valve, only a single tank of water will be allowed to leak, and the empty tank will provide an indication or detection of leakage at the next flush cycle.

These and other objects and advantages of the present invention will become apparent from the following description of the preferred embodiments taken in conjunction with the accompanying drawings.

DESCRIPTION OF THE PREFERRED EMBODIMENTS

Figures 1, 2, 3, 4:
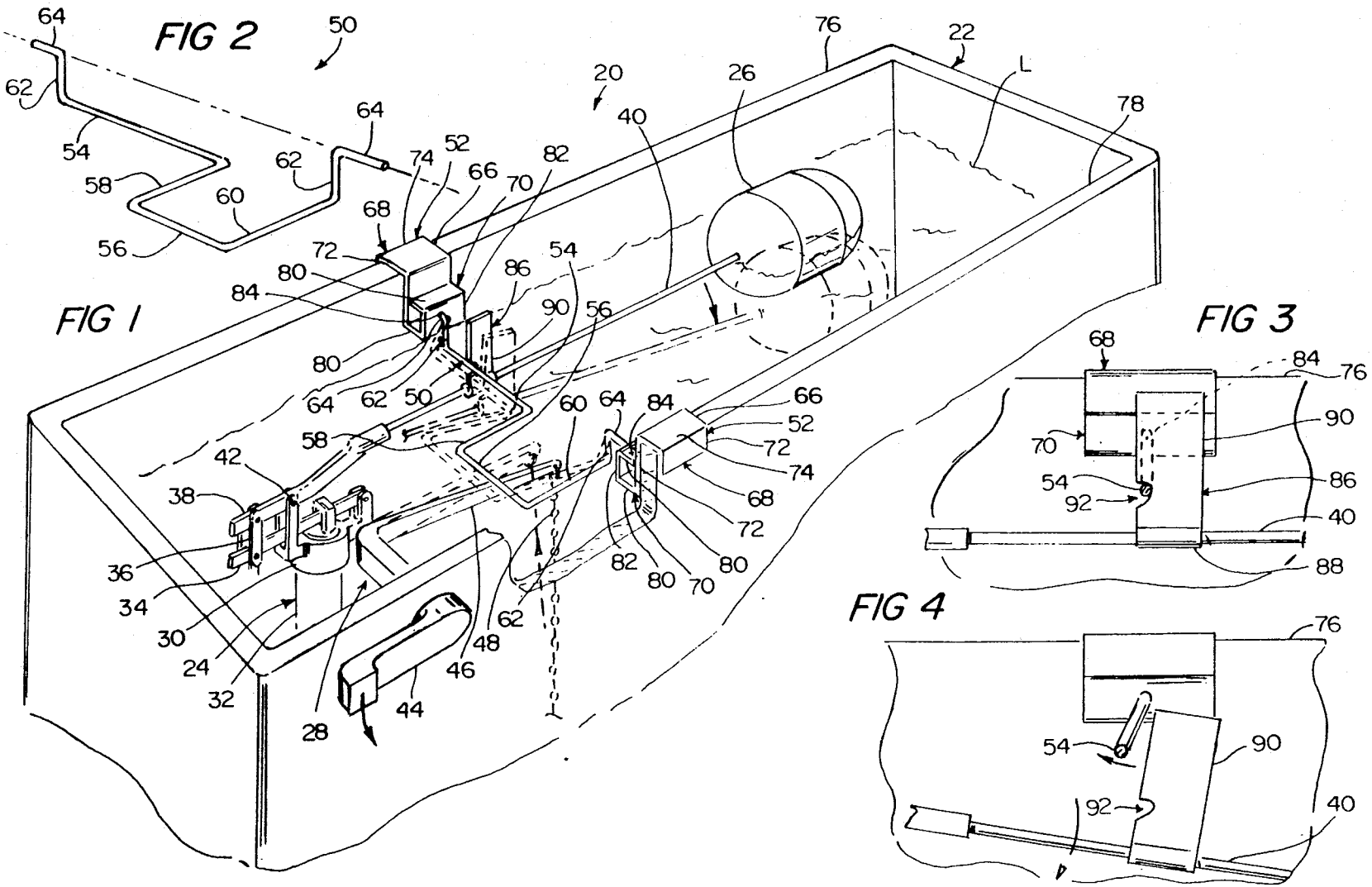
FIG. 1 is a broken perspective view, partly in section, of a flush valve leakage prevention and detection device according to the present invention.
FIG. 2 is a perspective view of a latch for the flush valve leakage prevention and detection device of FIG. 1.
FIG. 3 is a broken front view, partly in section, of the flush valve leakage prevention and detection device of FIG. 1 showing the float arm in a raised, latched position.
FIG. 4 is a broken front view, partly in section, of the flush valve leakage prevention and detection device of FIG. 1 showing the float arm in a lowered, unlatched position.

A flush valve leakage prevention and detection device according to the present invention is shown at 20 in FIG. 1 installed in a toilet tank 22 having a conventional water inlet valve assembly 24 controlled by a float 26 and a flush mechanism 28 for initiating a flush cycle in the toilet tank 22. Water inlet valve assembly 24 is of the ball cock type including a head 30 disposed at an upper end of a water supply pipe 32 secured to a bottom or lower wall (not shown) of the tank 22 the head 30 mounting a ball cock water inlet valve for controlling flow of water from the supply pipe 32 into the toilet tank 22. The water inlet valve is raised off a valve seat to an open position allowing water to flow into the tank 22 from the supply pipe 32 by a pivotally mounted operating hinge 34 connected by a link 36 to a float lever 38 securing an end of a float arm 40, the buoyant float 26 being mounted at a free end of the float arm 40. The float lever 38 is pivotally mounted on the water inlet valve assembly 24 at a pivot 42, such that the float lever 38 and the float arm 40 form a continuous extension from link 36 to float 26; and, accordingly, the terms float lever and float arm are used interchangeably herein. The float lever 38 and, therefore, the float arm 40, will pivot around pivot 42 in response to raising and lowering of the float 26 with the water level in the toilet tank causing the operating hinge 34 to be pivoted via link 36 to open or close the water inlet valve assembly 24. Flush mechanism 28 includes a flush handle 44 mounted externally of tank 22 and a flush lever 46 joined to flush handle 44 and disposed in the toilet tank 22 to extend in the same direction as float arm 40. An end of a chain 48 is secured to the flush lever 46, and an opposite end of the chain 48 is attached to a flush valve (not shown) seated in a discharge opening in the bottom wall of the toilet tank. Rotation of the flush handle 44 in a counterclockwise direction looking at FIG. 1 causes flush lever 46 to be pivoted or rotated upwardly in a counterclockwise direction, with chain 48 being pulled upwardly by the flush lever 46 to open the flush valve and thusly initiate a flush cycle. During the flush cycle, water in the toilet tank 22 is discharged through the discharge opening until there is insufficient water in the tank to float the flush valve, and the flush valve returns to seat in the discharge opening closing the discharge opening and preventing further release of water from the toilet tank. As the level of water in the toilet tank 22 falls during the flush cycle, float 26 descends causing the float arm 40 and float lever 38 to pivot downwardly around pivot 42 opening the water inlet valve assembly 24 to supply water to refill the tank. Once the water level in the tank 22 has returned to the predetermined level with water supplied from the water inlet valve assembly, float 26 will again be raised by the water level, causing float arm 40 and float lever 38 to pivot and close the water inlet valve assembly 24. When water leaks from the toilet tank 22 between flush cycles, such as when the flush valve is impaired or does not properly seat allowing water to leak through the discharge opening, the water level in the toilet tank will drop from the predetermined level. Accordingly, the float 26 and, therefore, the float arm 40 and float lever 38, will pivot downwardly in response to lowering of the water level, and the water inlet valve assembly 24 will be maintained open allowing water to enter the tank to replenish that lost through leakage.

The flush valve leakage prevention and detection device 20 as shown in FIG. 1 includes a latch 50 positioned by support 52 to hold float arm 40 in a raised, latched position corresponding to a closed position for the water inlet valve assembly 24 and to release the float arm 40 via a camming action in response to actuation of flush lever 46. Latch 50 as shown in FIGS. 1 and 2 is preferably formed of a length of wire or rod bent or configured to form a substantially straight locking arm 54 and a control arm 56 parallel with locking arm 54 and having a first end perpendicularly joined to a first end of the locking arm by a connecting section 58. A second end of the control arm 56 is joined perpendicularly to an extension 60 parallel with the connecting section 58, with the extension 60, the connecting section 58, the control arm 56 and the locking arm 54 being co-planar. The extension 60 and a second end of the locking arm 54 are joined perpendicularly to mounting bars 62 bent in the same direction from the extension 60 and the locking arm 54, respectively, at right angles and terminating at fingers 64 disposed at right angles with the mounting bars. The mounting bars 62 and the fingers 64 are disposed in a plane perpendicular with the plane containing the extension 60, the connecting section 58, the control arm 56 and the locking arm 54. Support 52 each includes a pair of brackets 66 each having an end 68 with a generally U-shaped configuration and a hanger 70 joined to end 68 for pivotably mounting latch 50. Ends 68 each include a pair of opposing sides 72 joined perpendicularly by a base 74 such that the ends 68 can be clipped or hooked onto the rear and front walls 76 and 78, respectively, of the toilet tank 22 with the thickness of the walls disposed between the sides 72 and the base 74 supported on the upper edge surfaces of the walls. Hangers 70 have a generally U-shaped configuration bent from ends 68 and each includes a pair of sides 80 and a plate 82 perpendicularly joining the sides 80, with one of the sides 80 perpendicularly joined to a side 72 of ends 68 such that the hangers 70 are disposed within toilet tank 22 with ends 68 mounted on the rear and front walls. Holes or pivots 84 are formed in plates 82 of hangers 70 for receiving fingers 64 to mount the latch 50 within the toilet tank 22 while permitting rotation of the latch around the pivots 84. A catch mechanism 86 as shown in FIGS. 1, 3 and 4 is mounted on float arm 40 and includes a cylindrical lower end 88 frictionally receiving the float arm 40 therein and a plate-like catch 90 extending outwardly from the cylindrical lower end 88 and having a mouth or recess 92 formed along a lateral edge thereof.

According to a method of operation for the flush valve leakage prevention and detection device 20, brackets 66 are mounted on the rear and front walls 76 and 78, respectively, of the toilet tank 22 as shown in FIG. 1 with the brackets 66 aligned in a direction transverse to the rear and front walls. Fingers 64 are secured in the holes or pivots 84 of the hangers 70 such that the latch 50 is disposed in a rest position in the toilet tank with the locking arm 54 disposed over the float arm 40 in spaced relation therewith and the control arm 56 engaged by and supported on an upper surface of the flush lever 46, the locking arm and the control arm being disposed transverse to the float arm and the flush lever, respectively. Catch mechanism 86 is mounted on float arm 40 such that locking arm 54 is received within the mouth 92 of the catch 90 as shown in FIGS. 1 and 3 such that the float arm 40 is held in a raised, latched position corresponding to a closed position for the water inlet valve assembly 24. With the latch 50 in the rest position, the greater weight of the control arm 56, together with the weight of connecting section 58 and the extension 60, outwardly from the pivots 84 biases the latch to rotate counterclockwise around pivots 84 looking at FIG. 1, and the control arm 56 is, therefore, supported on the flush lever 46. When the flush handle 44 is moved downwardly in the direction of the arrow shown in FIG. 1 to initiate a flush cycle with the water level in the toilet tank 22 at the predetermined level L, flush lever 46 will be moved upwardly causing the latch 50 to rotate in a clockwise direction against the rotational bias as shown in broken lines in FIG. 1. Control arm 56 will be moved upwardly by the flush lever 46 and the locking arm 54 will be moved outwardly from the catch 90, as shown in FIG. 4 and in broken lines in FIG. 1, moving the locking arm 54 out of the mouth 92 and thusly releasing or unlatching float arm 40. Float arm 40 is then free to descend to a lowered position with float ball 26 as the water level in the toilet tank drops due to opening of the flush valve via actuation of the flush lever 46, and the latch 50 automatically returns to the rest position due to the rotational bias provided by the relatively greater weight at the control arm 56. With lowering of float arm 40, the water inlet valve assembly 24 will be opened supplying water to the toilet tank 22 to refill the tank upon closure of the flush valve. As the water level in the tank again rises, the float arm 40 rises with ball 26 such that the lateral edge of the catch 90 engages and rides along the locking arm 54 pushing the latch outwardly, i.e. clockwise, until the mouth 92 is aligned with the locking arm 54, and the locking arm 54 slips into the mouth to lock the float arm 40 in the raised, latched position. Should water leak from the toilet tank 22 between flush cycles, the float arm 40 will remain held by latch 50 in the raised, latched position preventing the float arm from descending such that the water inlet valve will remain closed. Accordingly, only a single tank of water can leak from the toilet tank 22 and further leakage thereafter is prevented. When the next flush cycle is initiated, there will be insufficient water in the tank 22 to flush the toilet; and, therefore, the flush handle 44 will have to be rotated twice in order to flush the toilet, a first time to open the water inlet valve assembly 24 to refill the tank with water and a second time to discharge the water from the toilet tank thusly alerting the consumer to a leakage problem.

Brackets 66 can be adjustably mounted on the toilet tank 22 by moving the brackets longitudinally along the front and rear walls of the toilet tank allowing latch 50 to be mounted to accommodate the water inlet valve assemblies and flush mechanisms of various different types of toilet tanks. The ends 68 of brackets 66 can have various configurations for securing the brackets 66 on the toilet tank 22, and the side walls of the toilet tank can be utilized for mounting brackets 66. Hangers 70 can have various configurations and can be designed with plates 82 having a plurality of holes or pivots 84 for receiving the mounting fingers 64 whereby the latch 50 ca be mounted at selected vertical positions within the toilet tank. Latch 50 is preferably made of integral, unitary construction formed by bending a single length of wire to allow customization for various diverse types of toilet tanks, water inlet valve assemblies and flush mechanisms. The fingers 64 of latch 50 can be bent to engage a side 80 of the hangers 70 when the latch is rotated clockwise by the flush lever 46 thusly serving as a positive stop or abutment limiting rotational movement of the latch such that the latch does not hit a cover or lid of the toilet tank 22. Catch mechanism 90 can be moved along the float arm 40 to adjustably mount the catch to accommodate the location of the latch 50 and to position the catch such that the plate 90 does not contact the cover or lid for the toilet tank. The catch mechanism 86 can have various configurations to engage locking arm 54 and support the float arm 40 in the raised, latched position.

Figures 5, 6, 10, 11, 12, 13, 14:
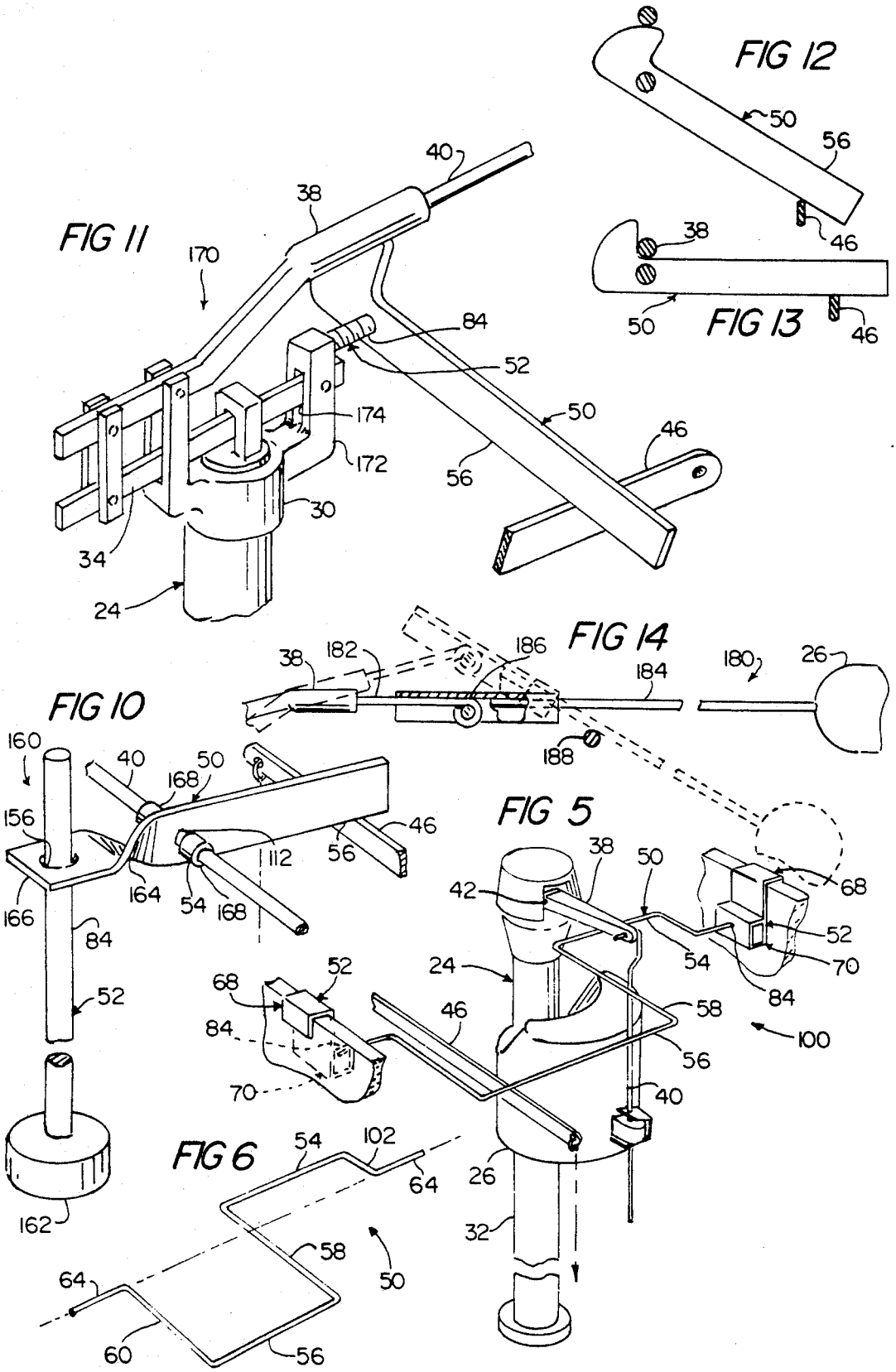
FIG. 5 is a broken perspective view, partly in section, of a modification of a flush valve leakage prevention and detection device according to the present invention.
FIG. 6 is a perspective view of a latch for the flush valve leakage prevention and detection device of FIG. 5.
FIG. 10 is a broken perspective view of a further modification of a flush valve leakage prevention and detection device according to the present invention.
FIG. 11 is a broken perspective view of an additional modification of a flush valve leakage prevention and detection device according to the present invention.
FIG. 12 is a side view, partly in section, of the flush valve leakage prevention and detection device of FIG. 11 showing the float lever in a raised, latched position.
FIG. 13 is a side view, partly in section, of the flush valve leakage prevention and detection device of FIG. 11 showing the float lever in a lowered, unlatched position.
FIG. 14 is a broken front view, partly in section, of a float arm assembly for the flush valve leakage prevention and detection device according to the present invention.

A modification of a flush valve leakage prevention and detection device according to the present invention is shown in FIG. 5 at 100, with the flush valve leakage prevention and detection device 100 being shown utilized with a FLUIDMASTER type water inlet valve assembly 24. The water inlet valve assembly 24 includes a water supply pipe 32 mounted on a bottom or lower wall of a toilet tank 22 and containing a water inlet valve and a buoyant float 26 slidably mounted on the supply pipe 32 for upward and downward movement therealong in response to raising and lowering of the water level within the tank. The float 2 is coupled by a float arm 40 to a float lever 38 that is pivotally mounted at 42 for pivotal movement in response to movement of the float 26 along the supply pipe to close the water inlet valve when the float is in a raised position corresponding to a predetermined water level in the toilet tank and to open the water inlet valve when the float is in a lowered position due to the water level in the tank having dropped from the predetermined level. The flush valve leakage prevention and detection device 100 includes a latch 50 for supporting the float lever 38 in a raised, latched position corresponding to a closed position for the water inlet valve assembly and support 52 for mounting the latch 50 within the toilet tank 22. Support 52 includes a pair of brackets 66 each having an end 68 for being hooked or clipped onto the front and rear walls 76 and 78, respectively, of the toilet tank and a hanger 70 having one or more holes or pivots 84 for pivotally mounting latch 50 as described in connection with FIG. 1. Latch 50, as shown in FIGS. 5 and 6, is preferably formed of a single length of wire or rod bent or configured to form a substantially straight locking arm 54 and a control arm 56 parallel with locking arm 54 and having a first end perpendicularly joined to a first end of the locking arm 54 by a connecting section 58. A second end of the control arm 56 is joined perpendicularly to an extension 60, and a second end of the locking arm 54 is joined perpendicularly to an extension 102 that is shorter in length than the extension 60. Mounting fingers 64 are bent outwardly at right angles from the extensions 60 and 102, respectively, with the extensions 60 and 102, the connecting section 58, the control arm 56, the locking arm 54 and the fingers 64 being co-planar. The mounting fingers 64 are received in the pivots 84 to mount the latch 50 within the toilet tank 22 while permitting rotation of the latch around the pivots 84.

According to a method of operation for the flush valve leakage prevention and detection device 100, brackets 66 are mounted on the rear and front walls 76 and 78, respectively, of the toilet tank 22 as shown in FIG. 5 with the brackets aligned in a direction transverse to the rear and front walls. Mounting fingers 64 are secured in holes or pivots 84 of the hangers 70 such that the latch 50 is disposed in a rest position within the toilet tank with the locking arm 54 disposed under and supporting the float lever 38 and the control arm 56 disposed over and supported by the flush lever 46, with the locking arm 54 and the control arm 56 extending transverse to the float lever 38 and the flush lever 46, respectively. The relatively greater weight of the latch 50 at the control arm 56 outwardly from the pivots 84 rotationally biases the latch 50 clockwise around pivots 84 looking at FIG. 5 such that the locking arm 54 is urged upwardly against the float lever 38 and the control arm 56 is urged downwardly against the flush lever 46. Accordingly, the float lever 38 is firmly held by the latch 50 in a raised, latched position corresponding to a closed position for the water inlet valve assembly 24 and the control arm 56 is urged against the flush lever. When a flush cycle is initiated with the water level in the toilet tank at the predetermined level L, the flush lever 46 will be rotated upwardly in a counterclockwise direction looking at FIG. 5 causing the latch 50 to rotate counterclockwise. With counterclockwise rotation of latch 50, the control arm 56 will be moved or cammed upwardly by the flush lever 46 while the locking arm 54 will be moved downwardly thusly releasing or unlatching the float lever 38. The float 26 is then free to descend along the supply pipe 32 to a lowered position as the water level in the tank drops due to opening of the flush valve via the flush lever 46. The float lever 38 will be pivoted downwardly, or clockwise, around pivot 42 in response to lowering of the float 26 due to coupling of float 26 with the float lever 38 via the float arm 40 to open the water inlet valve assembly 24, with the weight of the float 26 upon float lever 38 causing the float lever to override the rotational bias of the latch 50. As the water level in the tank rises with water supplied from the water inlet valve assembly 24, the float 26 rises causing the float lever 38 to pivot upwardly, or counterclockwise, around pivot 42 while the greater weight of the latch 50 at the control arm 56 allows the latch to automatically return to the rest position such that the locking arm 54 again supports the float lever 38 in the raised, latched position corresponding to closure of the water inlet valve assembly. Should water leak from the toilet tank between flush cycles, the float lever 38 will remain held by latch 50 in the raised position such that the water inlet valve assembly will remain closed. Only a single tank of water will be allowed to leak from the toilet tank in the event of leakage, and the empty tank will serve as an indication of leakage at the next flush cycle. In some cases, the FLUIDMASTER type water inlet valve assemblies are formed with a notch along a lower surface of the float lever, and the latch 50 can be arranged such that the locking arm 54 engages the notch in the latched position. Toilet tanks employing FLUIDMASTER water inlet valve assemblies tend to have more standardized arrangements of water inlet valve assemblies and flush mechanisms while toilet tanks employing ball cock type water inlet valve assemblies tend to have more variable arrangements of parts. Accordingly, the flush valve leakage prevention and detection device 100 can be standardized more easily and may eliminate customization by the installer.

Figures 7, 8, 9:
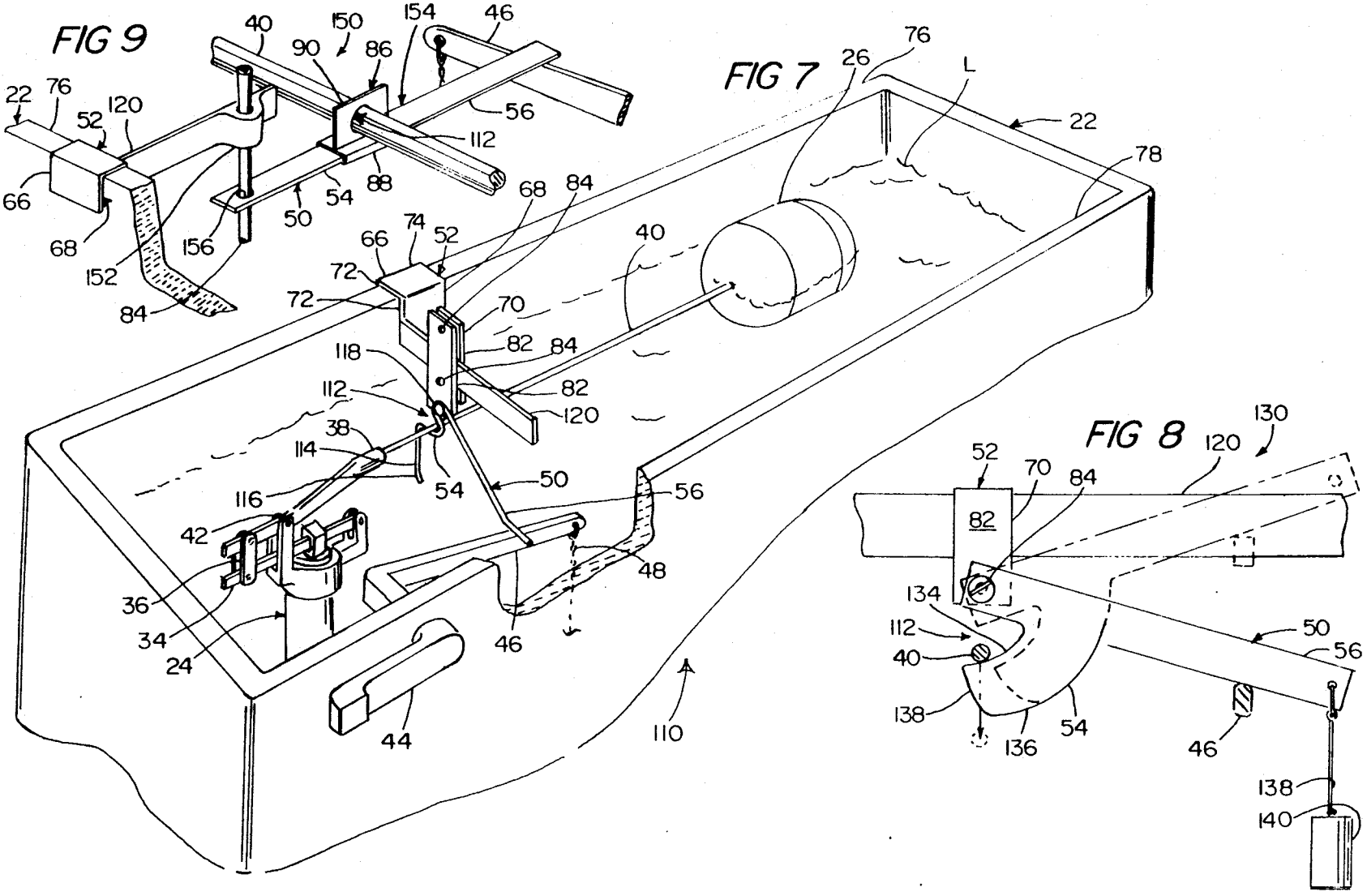
FIG. 7 is a broken perspective view, partly in section, of a further modification of a flush valve leakage prevention and detection device according to the present invention.
FIG. 8 is a broken side view, partly in section, of another modification of a flush valve leakage prevention and detection device according to the present invention.
FIG. 9 is a broken perspective view, partly in section, of another modification of a flush valve leakage prevention and detection device according to the present invention.

A further modification of a flush valve leakage prevention and detection devise according to the present invention is shown in FIG. 7 at 110. The flush valve leakage prevention and detection device 110 includes a latch 50 for maintaining the float arm 40 in a raised, latch position and for releasing the float arm upon actuation of the flush lever 46 and a support 52 for mounting latch 50. Latch 50 includes a length of rod or wire bent or configured in a single plane to form an acutely angled or V-shaped locking arm 54 defining a mouth or recess 112 for receiving float arm 40, a cam member including a tail 114 depending from locking arm 54 and terminating at a nub 116, an arcuate section 118 joined to locking arm 54 and bent in a direction opposite locking arm 54 and a control arm 56 extending angularly from arcuate section 118 to flush lever 46, the control arm 56 being engaged by and supported on an upper surface of the flush lever 46. Support 52 includes a bracket 66 for being supported on the toilet tank 22 and a hanger 70 adjustably, movably mounted on bracket 66 for supporting latch 50 within the toilet tank such that the float arm 40 in the raised position is received in the mouth 112 of the latch 50. Bracket 6 has an end 68 bent in a generally U-shaped configuration to form a base 74 and a pair of generally parallel sides 72 joined perpendicularly to base 74, and a mounting strip 120 extending perpendicularly from a lateral edge of one of the sides 72. Base 74 and sides 72 are configured such that the thickness of a rear wall 76 of the toilet tank 22 can be received between sides 72 with base 74 extending over an upper edge surface of rear wall 76 as shown in FIG. 7 allowing bracket 66 to be clipped or hooked onto the toilet tank 22. Mounting strip 120 is joined to end 68 and configured to extend into the toilet tank 22 in a direction transverse to rear wall 76 and a front wall 78 of the toilet tank, with the mounting strip 120 being disposed in a plane perpendicular with float arm 40. Hanger 70 includes a pair of plates 82 disposed on opposite sides of mounting strip 120 such that a minor dimension, i.e. the thickness, of the mounting strip is sandwiched between the plates 82 with the plates being secured together by screws or pivots 84 passing through the plates. One of the screws 84 can be loosened to permit a head of the screw to protrude from one of the plates 82 allowing arcuate section 118 to be disposed around a shank of the screw 84 to suspend the latch 50 from the hanger 70. Screw or pivot 84 can then be tightened to frictionally secure the latch while allowing the latch to rotate freely around the pivot 84. With the latch 50 supported in the toilet tank 22 by support 52, the latch will be disposed in a plane perpendicular with the float arm 40 and the flush lever 46, float arm 40 will be received in mouth 112, and the weight of control arm 56 outwardly of the pivot 84 will bias the latch rotationally in a clockwise direction around pivot 84 such that the control arm 56 will be engaged by and supported on the flush lever 46 and the locking arm 54 will provide an upward thrust on the float arm 40.

According to a method of operation for the flush valve leakage prevention and detection device 110, the water level in toilet tank 22 is normally at predetermined level L, as shown in FIG. 7, with the water supporting buoyant float 26 in a raised position. The float arm 40 and the float lever 38 will be in a raised position corresponding to a closed position for the water inlet valve assembly 24. Latch 50 will be disposed in a rest position shown in FIG. 7 locking float arm 40 in the raised, latched position with the float arm held in mouth 112 and the control arm 56 supported on and biased against flush lever 46. When flush handle 44 is moved downwardly to initiate a flush cycle, flush lever 46 will be moved upwardly, rotating counterclockwise looking at FIG. 7, and, via engagement with control arm 56, the flush lever 46 will rotate latch 50 in a counterclockwise direction around pivot 84 against the rotational bias. Upon rotation of latch 50, locking arm 54 will be moved out of engagement with the float arm 40, and the float arm 40 will be unlatched or released, the latch 50 automatically returning to the rest position due to the rotational bias provided by control arm 56. As the water level in the toilet tank 22 drops due to the flush valve having been opened with actuation of the flush lever 46, the float 26 will descend causing the float arm 40 and float lever 38 to pivot downwardly around pivot 42 to a lowered position such that operating hinge 34 is raised via link 36 and the water inlet valve assembly 24 is opened. The toilet tank 22 will be refilled with inlet water upon closure of the flush valve, and the float 26 rises with the water level in the tank. Float arm 40 will contact nub 116 of latch 50 and will move or rotate the latch upwardly in a counterclockwise direction around pivot 84, the float arm 40 moving upwardly along cam 114 in a camming or sliding action with the upward force of the float arm overcoming the rotational bias of the latch. Once the float arm 40 reaches mouth 112, the latch 50 is free to return to the rest position due to the rotational bias, and the float arm 40 is again firmly held within mouth 112 in the raised, latched position thusly ending the flush cycle. If the water level in the toilet tank 22 should fall from the predetermined level between flush cycles, such as due to leakage through the flush valve, the float arm 40 will remain engaged with latch 50 and will be, therefore, locked in a raised, latched position. With the float arm 40 locked in the raised position, water inlet valve assembly 24 will remain closed and the water discharged from the toilet tank 22 due to leakage will not be replenished. Only a single tank of water will be allowed to leak from the toilet tank and the empty tank discovered upon initiation of the next flush cycle will serve as a indication of leakage.

Bracket 66 can be mounted at various locations along rear wall 76, and the front and side walls of the toilet tank can be utilized to mount bracket 66. Hanger 70 can be secured at various locations along the mounting strip 120; and, additionally, hanger 70 can be adjusted vertically relative to mounting strip 120 by sliding plates 82 upwardly or downwardly relative to the mounting strip and thereafter securing the plates with the screws 84. Accordingly, the support 52 can be utilized with various diverse types of toilet tanks, water inlet valve assemblies and flush mechanisms and can be easily retrofit to existing toilet tanks.

Latch 50 can be formed of bendable wire allowing the latch to be bent or configured as needed during installation to support the float arm 40 and to be suspended from hanger 70, and the control arm 56 can be bent to contact the flush lever 46 such that the latch can be used with various diverse types of supports, water inlet valve assemblies and flush mechanisms to support a float arm or lever for the water inlet valve assembly and to be engaged by the flush mechanism for releasing the float arm or lever in response to movement of the flush mechanism. Although the leakage prevention and detection device 110 is shown with a ball cock type water inlet valve assembly, it will be appreciated that the flush valve leakage prevention and detection device 110 can be utilized with a FLUIDMASTER type water inlet valve assembly, shown in FIG. 5, by forming the latch 50 to engage and support the lever arm 38 of the FLUIDMASTER valve in mouth 112. Latch 50 can be configured during installation to be customized in accordance with various diverse types of toilet tanks, supports, water inlet valve assemblies and flush mechanisms permitting the latch to be easily retrofit to existing toilet tanks.

A modification of a flush valve leakage prevention and detection device according to the present invention is illustrated at 130 in FIG. 8. Flush valve leakage prevention and detection device 130 includes a support 52 to be mounted on a toilet tank 22 and a latch 50 supported by support 52 to hold float arm 40 in the raised, latched position corresponding to a closed position for the water inlet valve assembly as described in connection with FIG. 7. Support 52 includes a mounting strip 120 supported on the toilet tank 22 by one or more brackets 66 (not shown), such that the mounting strip 120 extends transverse to the front and rear walls 76 and 78, and a hanger 70 adjustably, movably mounted on mounting strip 120. The mounting strip 120 can be supported on the walls of the toilet tank 22 by any suitable device, including the brackets 66 of FIG. 7, and the device for mounting the mounting strip 120 on the toilet tank can be selected to allow vertical adjustment of the mounting strip 120 within the toilet tank as well as longitudinal adjustment of the mounting strip along the walls of the toilet tank. The mounting strip 120 of the flush valve leakage prevention and detection device 130 can be mounted on the toilet tank 22 via devices at one or both ends of the mounting strip, and various other arrangements can be employed for mounting the mounting strip on one or more walls of the toilet tank. Hanger 70 is bent to form a generally U-shaped configuration for being clipped or hooked onto mounting strip 120 and includes a side or plate 82 slidable along the length of the mounting strip via frictional engagement of the hanger 70 with mounting strip 120, or the hanger 70 can be formed as a pair of plates 82 to be adjustably secured on the mounting strip 120 by screws 84 as discussed in connection with FIG. 7. Latch 50 includes a planar body 132, preferably made as a unitary, integral molding of plastic and having a control arm 56 pivotally mounted on plate 82 by screw 84 and an arcuate locking arm 54 extending angularly from the control arm 56 to define a mouth 112 for receiving the float arm 40. Locking arm 54 has an inner edge 134 defining a bottom of the mouth 112, with inner edge 134 being curved in the direction of pivot 84 to provide a lift on the float arm 40, and an outer edge 136 following the curvature of inner edge 134 and joined to inner edge 134 by a curved cam surface 138. Control arm 56 extends beyond the flush lever 46, and an end of a chain or wire 138 carrying a weight 140 is attached to an end of the control arm 56.

According to a method of operation for the flush valve leakage prevention and detection device 130, support 52 is mounted in toilet tank 22 with mounting strip 120 extending transverse with rear and front walls 76 and 78, respectively, of the toilet tank. Latch 50 is pivotally mounted on mounting strip 120 such that the latch is disposed in a plane transverse to float arm 40 and flush lever 46. The latch 50 is disposed in a rest position with float arm 40 received in the mouth 112 of the latch 50 and, therefore, held in a raised, latched position with the water level in the toilet tank being at the predetermined level L supporting float 2 such that the water inlet valve assembly for the toilet tank is closed. The weight of control arm 56 together with the weight 140 pulling downwardly on the control arm bias the latch 50 rotationally around pivot 84 and provides an upward thrust at inner edge 134 to firmly hold the float arm 40 in the latched position. With the latch 50 in the rest position, the weight of control arm 62 and the weight 100 causes the end of the control arm to be engaged by and supported on the flush lever 46. When flush handle 44 is rotated to initiate a flush cycle, the flush lever 46 will be moved upwardly looking at FIG. 8 and, via engagement of the flush lever with the control arm 56, will cam or rotate the latch 50 around pivot 84 in a counterclockwise direction looking at FIG. 8. With rotation of latch 50, locking arm 54 will be moved out of engagement with the float arm 40, and the float arm will be released or unlatched from the latch 50, allowing the float arm 40 to fall with the water level in the tank to open the water inlet valve assembly to refill the tank upon closure of the flush valve with the rotational bias of the latch 50 causing the latch to automatically return to the rest position. As the tank refills, float arm 40 will ascend with float 26, and the float arm 40 will engage and push against the cam surface 138 of the latch 50 such that the float arm 40 cams or rotates the latch 50 in a counterclockwise direction around pivot 84, the upward force of the float arm overcoming the rotational bias of the latch 50. The float arm 40 will ride along the curved cam surface 138 of the latch 50 until mouth 112 is reached, whereupon latch 50 will be free to rotate downwardly in a clockwise direction due to the rotational bias to return to the rest position such that inner edge 134 moves under the float arm 40 and the float arm 40 is firmly held in the mouth 112 of the latch 50 with an upward thrust thusly terminating the flush cycle. If water leaks from the toilet tank between flush cycles, the float arm 40 remains held by latch 50 in the raised, latched position such that the water inlet valve assembly can not be opened and only a single tank of water can leak from the tank. There will be insufficient water to flush the tank at the next flush cycle, requiring actuation of the flush lever 46 twice and thusly alerting the consumer to the leakage. It will be appreciated that the flush valve leakage prevention and detection device 130 can be utilized with a FLUIDMASTER water inlet valve assembly by mounting latch 50 such that the lever arm 38 is received in mouth 112 and held by inner edge 134.

A further modification of a flush valve leakage prevention and detection device is illustrated at 150 in FIG. 9 and includes a support 52 to be disposed in toilet tank 22 and a latch 50 to be mounted on support 52 for holding float arm 40 of a float controlled water inlet valve assembly in a raised, latched position corresponding to a closed position for the water inlet valve assembly. The support 52 includes a bracket 66 having an end 68 with a generally U-shaped configuration to be clipped or hooked onto the rear wall 76 of the toilet tank 22 and a mounting strip 120 joined to end 68 as described in connection with FIG. 7. Mounting strip 120 has a semi-cylindrical bump 152 thereon with a post or pivot 84 extending through an opening in bump 152. Latch 50 includes an elongate, flat strip or body 154 defining a locking arm 54 and a control arm 56 unitarily, integrally joined to the locking arm in longitudinal alignment therewith. A hole 156 is formed in the locking arm 54 to pivotally mount the body 154 on the pivot 84, the hole 156 being tapered from an upper surface to a lower surface of the body 154. A catch mechanism 86 is provided on the body 154 and includes a lower end 88 bent to receive the locking arm 54 and a plate-like catch 90 extending outwardly from the lower end. A mouth or aperture 112 is formed in the catch 90 for receiving the float arm 40 such that the float arm passes through the catch 90 transverse to body 154.

According to a method of operation for the flush valve leakage prevention and detection device 150, bracket 66 is mounted on a wall of toilet tank 22 with mounting strip 120 extending within the toilet tank transversely to float arm 40 and flush lever 46. The latch 50 is mounted on the float arm 40 by positioning the float arm to extend through mouth 112 in catch 90, and the latch is mounted on pivot 84 via hole 156. The weight of the control arm 56 outwardly from pivot 86 rotationally biases the latch 50 in a counterclockwise direction looking at FIG. 9 such that the control arm 56 is urged into supporting engagement upon the flush lever 46 with the latch 50 in a rest position. With the latch 50 in the rest position, the locking arm 54 will be slightly angled with the post 84 in the direction of the control arm causing the hole 156 to bind on post 84 preventing downward movement of the locking arm 54. Accordingly, float arm 40 is held by catch 90 in a raised, latched position corresponding to a closed position for the water inlet valve assembly. When the flush lever 46 is rotated during a flush cycle with the water level in the toilet tank at the predetermined level L, the control arm 56 will be rotated upwardly or counterclockwise relative to pivot 84 looking at FIG. 9 causing locking arm 54 to be positioned perpendicular with post 84 such that hole 156 no longer binds on the post 84 and the locking arm is free to descend along post 84 with the float arm 40 in response to lowering of the water level in the tank due to discharge of water through the flush valve. Upon lowering of the float arm 40, the water inlet valve assembly 24 will be opened supplying water to refill the toilet tank. As the toilet tank refills, the float arm 40 will move upwardly carrying latch 50 upwardly along the post 84 until the float arm reaches the raised position with the float 26 (not shown) at the end of the float arm supported by the water in the tank. Once the float arm 40 reaches the raised position, the weight of the control arm again tilts the latch 50 around pivot 84 causing hole 156 to bind on the pivot. In the event that water leaks from the toilet tank before the next flush cycle, the latch 50 will remain frictionally engaged with or bound on the post 84 such that the latch and, therefore, the float arm 40 cannot move downwardly, and the water inlet valve assembly cannot be opened to supply water to the toilet tank. The weight of the buoyant float 26 increases the downward force on the latch 50 further binding the latch upon the post 84.

Bracket 66 can be formed to allow longitudinal adjustment along the walls of the toilet tank, and the front, and side walls of the toilet tank can be used to mount the mounting strip within the toilet tank. The mounting strip can be formed in one or more pieces and can be designed to allow the length of the mounting strip within the toilet tank to be adjusted relative to end 68. Bump 152 can be formed integrally, unitarily with or separately from mounting strip 120, and bump 152 can be designed to permit the post 84 to be adjustably mounted on the mounting strip to vary the length of post 84 extending downwardly from the mounting strip into the toilet tank. When formed separately from the mounting strip, bump 152 can be moved longitudinally along the mounting strip allowing post 84 to be positioned in relation to the latch 50 and the float arm 40 to accommodate diverse toilet tank arrangements. Catch mechanism 86 can be mounted for longitudinal movement along the latch 50 to accommodate various structural arrangements for the flush valve assembly, the flush mechanism, the latch and the toilet tank. It will be appreciated that the flush valve leakage prevention and detection device 150 can be utilized on a FLUIDMASTER type water inlet valve assembly by arranging the float lever 38 of the FLUIDMASTER valve to extend through catch 90.

Another modification of a flush valve leakage prevention and detection device is illustrated at 160 in FIG. 10 and includes a support 52 to be disposed in toilet tank 22 and a latch 50 to be mounted on support 52 for holding a float arm 40 of a float controlled water inlet valve assembly in a raised, latched position corresponding to a closed position for the water inlet valve assembly. The support 52 includes a base 162 to be supported on a lower or bottom wall of the toilet tank and a cylindrical post or pivot 84 extending upwardly from base 162. Latch 50 includes a strip of metal twisted at 90° at 164 to form a locking arm 54, a control arm 56 unitarily, integrally joined to locking arm 54 in longitudinal alignment therewith and a mounting flange 166 joined to locking arm 54. A hole 156 having a diameter slightly larger than the diameter of post 84 is formed in mounting flange 166, the hole 156 tapering from a top side to a bottom side of the mounting flange 166. An aperture or mouth 112 is formed in the locking arm 54 for receiving the float arm 40 such that the float arm passes through the locking arm transverse to latch 50. A pair of rubber grommets 168 are disposed on the float arm 40 at opposite sides of the locking arm 54.

According to a method of operation for the flush valve leakage prevention and detection device 160, base 162 is supported on a lower or bottom wall of the toilet tank with post 84 extending upwardly from the base within the toilet tank. Latch 50 is mounted on post 84 by inserting the post in the hole 156, and the control arm 56 is positioned on the flush lever 46 with the float arm 40 passing through the mouth 112 in the locking arm 54. With the latch 50 in a rest position, the weight of the control arm 56 outwardly from pivot 84 rotationally biases the latch 50 downwardly at the flush lever 46, i.e. clockwise relative to pivot 84 looking at FIG. 10, such that the locking arm 54 is tilted relative to the post 84 and the hole 156 binds on the post 84 preventing downward movement of the latch 50 along the post and holding or latching the float arm 40 in a raised, latched position corresponding to a closed position for the water inlet valve assembly. When the flush lever 46 is rotated during a flush cycle with the water level in the tank at a predetermined level L, the control arm 56 will be moved upwardly or rotated counterclockwise relative to pivot 84 such that the locking arm 54 is perpendicular with the post 84 and the hole 156 is not angled or skewed with the post 84 allowing the latch 50 to move downwardly therealong. Accordingly, float arm 40 will be allowed to move downwardly in response to lowering of the water level in the toilet tank due to discharge through the flush valve assembly causing the water inlet valve to open to refill the tank upon closure of the flush valve. As the toilet tank refills, float arm 40 will move upwardly carrying the latch 50 therewith until the float arm 40 reaches the raised position with float 26 (not shown) at the end of the float arm supported by the water in the tank. Once the float arm has reached the raised position, the weight of the control arm 56 will tilt the latch 50 around pivot 84 causing the hole 156 to bind on the post 84. In the event that water leaks from the toilet tank between flush cycles, the latch 50 will remain frictionally engaged with or bound on the post 84 such that the latch and, therefore, the float arm 40 cannot move downwardly, and the water inlet valve assembly cannot be opened to supply water to the toilet tank. The weight of the buoyant float 26 at the end of the float arm 40 when the tank becomes empty increases the downward force on the control arm 56 further binding the latch 50 upon the post 84.

Although post 84 is shown with base 162 for supporting the post upon a lower wall of a toilet tank, it will be appreciated that the post 84 could be suspended or hung from a support mounted on one or more walls of the toilet tank. The support 52 and the latch 50 of the flush valve leakage prevention and detection device 160 can easily be retrofit to various, diverse toilet tanks by adjusting the position of the post 84, the length of the locking and control arms 54 and 56 and the location of the mouth 112 to suit various arrangements of water inlet valve assemblies and flush mechanisms. It will be appreciated that the flush valve leakage prevention and detection device 160 can be utilized with a FLUIDMASTER type water inlet valve assembly by arranging the float lever 38 of the FLUIDMASTER valve to extend through mouth 112 of latch 50.

A further modification of a flush valve leakage prevention and detection device according to the present invention is shown in FIG. 11 at 170, the flush valve leakage prevention and detection device 170 being formed as part of a ball cock type water inlet valve assembly 24 having a head 30 modified to include a mounting block 172 with a slot 174 therein receiving the operating lever 34 of the water inlet valve. The flush valve leakage and detection device 170 includes a support 52 and a latch 50 positioned by support 52 to hold the float lever 38 in a raised, latched position corresponding to a closed position for the water inlet valve assembly. Support 52 includes a bolt or pivot 84 secured on mounting block 172 to extend outwardly therefrom in the same direction as float lever 38 with the bolt 84 disposed in spaced relation with the float lever. Latch 50 includes a planar body having a control arm 56 and a locking arm 54 extending outwardly from the control arm. A hole is formed in the control arm 56 for receiving bolt 84 to pivotally mount the latch 50 on support 52. Locking arm 54 includes an arcuate edge 134 radially disposed with a longitudinal axis of the bolt 84 and a substantially straight edge 176 extending inwardly from arcuate edge 134 toward bolt 84 with the edge 176 being slightly offset from the longitudinal axis of the bolt as best shown in FIGS. 12 and 13 such that a recess is defined along the straight edge 176.

According to a method of operation for the flush valve leakage prevention and detection device 170, latch 50 is mounted on pivot 84 with the control arm 56 engaged by and resting on the flush lever 46 as shown in FIG. 11. With the latch 50 in a rest position, the weight of the control arm 56 biases the latch 50 rotationally in a clockwise direction around pivot 84 looking at FIG. 11 such that the control arm 56 is biased into resting engagement upon on the flush lever 46, and arcuate edge 134 of locking arm 54 is disposed beneath the float lever 38. Accordingly, the float lever 38 is held in a raised position corresponding to a closed position for the water inlet valve, the float lever being supported by the periphery of the locking arm 54 and, therefore, latched in the raised position as shown in FIGS. 11 and 12. When the flush lever 46 is actuated to initiate a flush cycle, the flush lever will be moved upwardly causing the latch 50 to rotate in a counterclockwise direction around pivot 84 as shown in FIG. 13 such that the straight edge 176 of the locking arm 54 moves past the float lever 38 allowing the float lever 38 to move downwardly towards the pivot 84 and into the recess along the edge 176 to a lowered position causing opening of the water inlet valve assembly. As the water rises during refilling upon closure of the flush valve, the float arm 40 and, therefore, the float lever 38, will rise in response to the rising water level, and the float lever 38 will be lifted upwardly in a direction outwardly from pivot 84. With the float lever 38 moved upwardly and out of engagement with edge 176, the latch 50 will rotate in a clockwise direction around pivot 84 due to the rotational bias such that the arcuate edge moves beneath the float lever, and the float lever is again supported by the periphery of the locking arm 54 in the raised, latched position. Should water leak from the toilet tank between flush cycles, the float lever 38 will remain supported upon the locking arm 54, and the float lever 38 will be prevented from descending such that the water inlet valve assembly can not be opened.

A float arm assembly for use with the flush valve leakage prevention and detection device of the present invention is shown at 180 in FIG. 14. Float arm assembly 180 includes an end 182 secured to float lever 38, a float arm 184 mounted on end 182 and carrying float 26, a hinge 186 pivotally joining float arm 184 with end 182 and a bar or plate 188 disposed in the toilet tank transverse to float arm 184. The bar or plate 188 can be mounted in the toilet tank by any of the brackets 66 discussed above, and is mounted to be positioned below the float arm 184 and spaced from the float arm 184 when the float arm is in a raised position corresponding to a closed position for the water inlet valve assembly. The float arm assembly 180 can replace the float arm 40 in any of the flush valve leakage prevention and detection devices utilizing a ball cock type water inlet valve assembly to increase the closing force applied at the water inlet valve in the event that the toilet tank is emptied due to leakage to insure that the inlet valve remains closed. In operation of the float arm assembly 180, in the event that the toilet tank becomes empty due to leakage, the weight of float 26 at the end of float arm 184 will cause the float arm 184 to pivot or rotate downwardly around the valve assembly until the float arm 184 contacts the bar 188 causing hinge 186 to be moved upwardly such that end 182 is pulled upwardly by the hinge and the downward force that the float lever 38 applies at the water inlet valve is increased by creating increased leverage from the weight of the float 26.

Having described preferred and alternative embodiments of a new and improved flush valve leakage prevention and detection device, it is believed that other modifications, variations and changes will be suggested to those skilled in the art in view of the teachings set forth herein, it is therefore to be understood that all such variations, modifications and changes are believed to fall within the scope of the present invention a defined by the appended claims.

What is claimed is:

1. A flush valve leakage prevention and detection device for utilization in a toilet tank having a flush lever movable to flush the toilet tank and a float controlled water inlet valve assembly operated by a float lever comprising latch means for holding the float lever in a raised position corresponding to a closed position for the water inlet valve assembly when the float lever is a tan upper position;

support means for pivotally mounting said latch means within the toilet tank; and control means operatively connected with said latch means and being supported directly on the flush lever, said fluid lever for pivoting said control means to simultaneously release the latch means in response to movement of the flush lever to flush the toilet tank whereby the float lever is allowed to move to a lowered position corresponding to an open position for the water inlet valve assembly.

2. A flush valve leakage prevention and detection device as recited in claim 1 wherein said latch means includes a recess and the float lever in the raised position is received in said recess.

3. A flush valve leakage prevention and detection device as recited in claim 2 wherein said latch means includes a bend defining said recess and said control means includes an arm extending outwardly from said bend, said bend and said arm being co-planar.

4. A flush valve leakage prevention and detection device as recited in claim 3 further including cam means on said latch means for allowing said latch means to be pivoted by the float lever upon the float lever moving from the lowered position to the raised position.

5. A flush valve leakage prevention and detection device as recited in claim 4 wherein said latch is formed from bendable wire.

6. A flush valve leakage prevention and detection device as recited in claim 2 wherein said latch means includes a planar body and said control means includes a control arm on said body and further including a locking arm on said body extending angularly from said control arm to define with said control arm said recess, said locking arm including a cam surface for allowing said latch means to be pivoted by the float lever upon the float lever moving from the lowered position to the raised position.

7. A flush valve leakage prevention and detection device as recited in claim 1 wherein said latch means includes a locking arm transverse to the float lever for supporting the float lever and said control means includes a control arm joined to and disposed parallel with said locking arm.

8. A flush valve leakage prevention and detection device as recited in claim 7 further including a catch member on the float lever having a recess therein for engaging said locking arm.

9. A flush valve leakage prevention and detection device as recited in claim 1 wherein said support means includes a post mounted in the toilet tank, said latch means includes a locking arm pivotally mounted on said post, said locking arm having a hole therein for allowing passage therethrough of the float lever, and said control means includes a control arm extending from said locking arm in longitudinal alignment therewith.

10. A flush valve leakage prevention and detection device for utilization in a toilet tank having a flush lever movable to flush the toilet tank and a float controlled water inlet valve assembly operated by a float lever comprising latch means for holding the float lever in a raised position corresponding to a closed position for the water inlet valve assembly when the float lever is at an upper position and preventing movement of the float lever to a lowered position corresponding to an open position for the water inlet valve assembly when the water in the toilet tank is lowered from a predetermined level;

support means having pivot means for pivotally mounting said latch means within the toilet tank; and control means operatively connected with said latch means for rotationally biasing said latch means to hold the float lever in the raised position and for being directly engaged by the flush lever, said control means being movable by the flush lever to flush the toilet tank, thereby simultaneously rotating said latch means against the rotational bias to release the float lever from said latch means whereby the float lever is allowed to move to a lowered position corresponding to an open position for the water inlet valve assembly.

11. A flush valve leakage prevention and detection device as recited in claim 10 wherein said biasing and engaging means includes a control arm on said latch means with the weight of said control arm biasing said latch means to rotate around said pivot means.

12. A flush valve leakage prevention and detection device as recited in claim 11 wherein said support means includes means for hanging said latch means from a wall of the toilet tank.

13. A flush valve leakage prevention and detection device as recited in claim 11 wherein said support means includes a post mounted in the toilet tank.

14. A flush valve leakage prevention and detection device as recited in claim 11 wherein said support means includes a pivot on the water inlet valve assembly.

15. A flush valve leakage prevention and detection device as recited in claim 11 further including a float arm mechanism having an end mounted on the float lever, a float arm hingedly mounted on said end and a float carried on said float arm, said float arm being pivotal around said end in response to lowering of the water level in the toilet tank from the predetermined level to increase the closing force applied by the float lever at the water inlet valve assembly.

16. A flush valve leakage prevention and detection device for utilization in a toilet tank having front and rear walls, a flush lever movable to flush the toilet tank and float controlled water inlet valve assembly operated by a float lever extending within the toilet tank in the same direction as the flush lever comprising latch means for holding the float lever in a raised position corresponding to a closed position for the water inlet valve assembly where the float lever is at an upper position;

means for pivotally supporting said latch means within the toilet tank; and control means operatively connected with said latch means and extending within the toilet tank in a direction transverse to the flush lever, said control means being biased into supporting engagement upon the flush lever, said control means being movable by the flush lever in response to movement of the flush lever to flush the toilet tank, thereby rotating said latch means to release the float lever to permit opening of the water inlet valve assembly whereby the float lever is allowed to move to a lowered position corresponding to an open position for the water inlet valve assembly.

17. A flush valve leakage prevention and detection device as recited in claim 16 wherein said latch means extends in a direction transverse to the float lever.

18. A flush valve leakage prevention and detection device as recited in claim 17 wherein said control means includes a control arm disposed in a plane perpendicular with the front and rear walls of the toilet tank.

19. A flush valve leakage prevention and detection device as recited in claim 18 wherein said latch means is disposed in a plane perpendicular with the front and rear walls of the toilet tank.

20. A flush valve leakage prevention and detection device for a toilet tank having a flush lever movable within the toilet tank for opening a flush valve to flush the toilet tank comprising a water inlet valve assembly mounted in the toilet tank and including a ball cock valve movable between closed and open positions to supply water to the toilet tank;

a lever arm pivotally mounted on said water inlet valve assembly to move said ball cock valve between said closed and open positions in response to pivotal movement of said lever arm, said lever arm being movable between a raised position wherein said ball cock valve is in said closed position and a lowered position wherein said ball cock valve is in said open position;

a float carried on said lever arm for maintaining said lever arm in said raised position when the water level in the toilet tank is at a predetermined level and for moving said lever arm to said lowered position in response to lowering of the water level in the toilet tank from the predetermined level;

latch means in the toilet tank for holding said lever arm in said raised position ; and support means on said water inlet valve assembly for pivotally mounting said latch means upon said water inlet valve assembly, said latch means including a control arm biased into resting engagement upon the flush lever and a locking section positioned by said bias to hold said lever arm to lock said lever arm in said raised position and prevent movement of said lever arm to said lowered position in response to lowering of the water level in the toilet tank from the predetermined level, said control arm being movable by the flush lever upon opening the flush valve to flush the toilet tank to move said locking section out of holding engagement with said lever arm to permit said lever arm to move to said lowered position in response to lowering of the water level in the toilet tank from the predetermined level.

* * * * *